US005596890A

United States Patent [19]

Suess

[11] Patent Number: 5,596,890

[45] Date of Patent: Jan. 28, 1997

[54] BEAKER TYPE DYEING MACHINE

[75] Inventor: Josef-Anton Suess, Buron/Lu, Switzerland

[73] Assignee: Datacolor International Applied Color Systems, Inc., Lawrence, N.Y.

[21] Appl. No.: 458,035

[22] Filed: Jun. 1, 1995

[30] Foreign Application Priority Data

Jun. 7, 1994 [CH] Switzerland ..... 1788/94

[51] Int. Cl.[6] ..... D06B 3/30; D06B 3/36; D06B 23/10

[52] U.S. Cl. ..... 68/15; 68/27; 68/171

[58] Field of Search ..... 68/15, 27, 171, 68/172, 173; 73/159

[56] References Cited

U.S. PATENT DOCUMENTS

| | | | |
|---|---|---|---|
| 3,379,038 | 4/1968 | Blancafort | 68/171 X |
| 3,606,773 | 9/1971 | Tabata | 68/15 |
| 4,059,013 | 11/1977 | Dietrich | 68/171 X |
| 4,393,671 | 7/1983 | Ito | 68/171 X |

FOREIGN PATENT DOCUMENTS

| | | | |
|---|---|---|---|
| 757253 | 3/1971 | Belgium | 68/171 |
| 513285 | 11/1930 | Germany . | |
| 2921404 | 11/1980 | Germany . | |
| 15450 | 9/1962 | Japan | 68/171 |
| 354407 | 7/1961 | Switzerland . | |
| 412765 | 11/1966 | Switzerland . | |
| 848509 | 7/1981 | U.S.S.R. | 68/172 |

*Primary Examiner*—Philip R. Coe
*Attorney, Agent, or Firm*—Ladas & Parry

[57] ABSTRACT

Each beaker is pivoted in such a manner that its longitudinal axis is tilted. Each beaker is equipped with a dosing hose, via which additives can be fed into the inner space of the beaker. Accordingly, the additives can be fed in a controlled manner and continuously or step-by-step into the beakers which are continuously moving, i.e. without any interruption of the movement of the beakers. This leads to a more uniform laboratory dyeing within the surface of the specimens.

4 Claims, 2 Drawing Sheets

BEAKER TYPE DYEING MACHINE

BACKGROUND OF THE INVENTION

1. Field of the Invention

The present invention relates to a beaker type dyeing machine, in which a plurality of beakers for materials to be dyed and dyeing liquor standing in a support are present, whereby each beaker is provided with a lid, having further a drive for the support for a reciprocating pivoting of the beakers for a shifting of their longitudinal axes, and having a heater for heating said beakers.

2. Description of the Prior Art

Such a beaker type dyeing machine is disclosed in the DE-PS 513 285. In this beaker type dyeing machine the support is surrounded by a case which is filled with water, whereby the water is heated by means of steam pipes arranged in the case such as to heat the beakers.

In case of dyeing procedures made in laboratories the artisan occupying himself with the improvement of textile articles must be able to rely on uniform results from the laboratory which allows him a precise, impeccable transferring of the recipe from the laboratory into the production works. The uniformity of the colorations depends on various parameters. Among others, a controlled adding of additives and also partly of the dyeing material into the inner space of the beakers at an arbitrarily selectable time is quite desirable because this is a substantial factor regarding the influence for a uniform dyeing. This is, however, not possible with known beaker type dyeing machines because no access from the outside to the beakers standing in the support and the support in turn located in the case exists. Also in case of other beaker type dyeing machines, in which the beakers are arranged along the periphery of a circular disk in such a manner that their longitudinal axes extend slanted in two planes relative to the axis of rotation of the circular disk, such that during the rotation of this circular disk these beakers perform a wobbling motion a controlled adding of additives is not possible because due to the rotation of the circular disk it is not possible to add any additives to the individual beakers when they are moving.

SUMMARY OF THE INVENTION

Thus, it is a general object of the present invention to provide a beaker type dyeing machine, with which above mentioned drawback is eliminated.

A further object of the invention is to provide a beaker type dyeing machine, in which each beaker is equipped with a dosing hose for adding additives into the inner space of the beaker, and in that the heater is designed as a planar-infrared-rays emitter apparatus.

By means of such a beaker type dyeing machine mentioned additives and possibly also dyeing materials may be fed in a controlled manner and specifically continuously or step-by-step into the beakers which are subject to a continuous movement, i.e. therefore without interrupting the movement of the beakers. By means of this a more uniform laboratory dyeing within the plane of the specimens is arrived at.

BRIEF DESCRIPTION OF THE DRAWINGS

The present invention will be better understood and objects other than those set forth above will become apparent when attention is given to the following description thereof and read in conjunction with the appended drawings, wherein.

DESCRIPTION OF THE PREFERRED EMBODIMENTS

Figure 1:
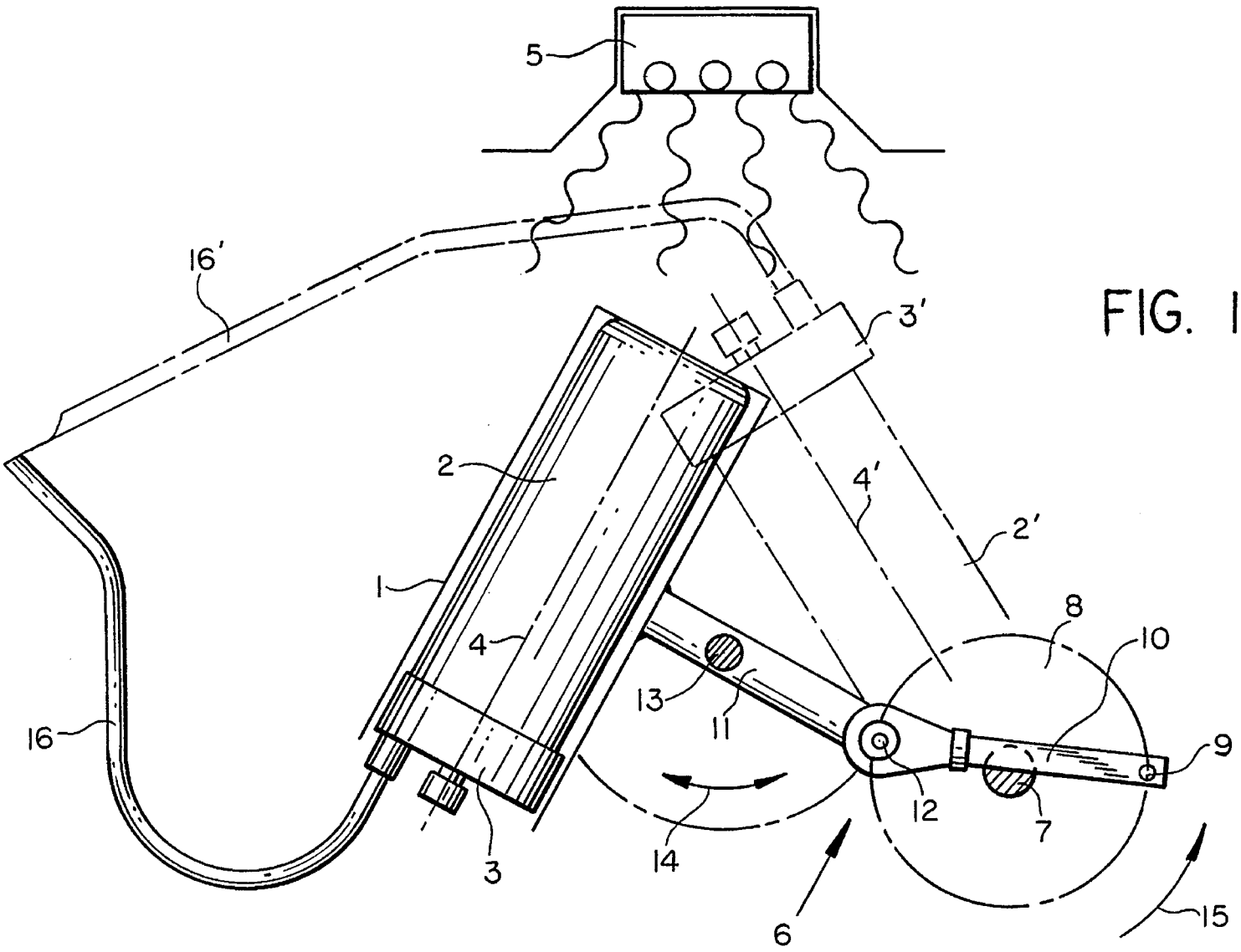
FIG. 1 illustrates a first embodiment, in which the support for the beakers is driven by means of a crank drive assembly.

The beaker type dyeing machine illustrated in FIG. 1 includes a support 1, in which a plurality of beakers 2 located one behind each other are supported. Each beaker has a lid 3. The beakers have a longitudinal axis 4. A heater 5 is located above the beakers 2, which heater 5 is intended to heat the beakers with their contents consisting of the not specifically illustrated matter being dyed and the dyeing liquor.

The support is equipped with a drive 6 for a reciprocating pivoting of the beakers 2 for a shifting of their longitudinal axes 4 into the position 4', in which position each lid 3 is located in the position 3' and the beakers 2 are located in the position 2'.

The drive 6 consists in the embodiment in accordance with FIG. 1 of a crank drive. The crankshaft 7 carries an overhung crank 8, which supports the crankshaft pin 9. A connecting rod 10 is pivotably mounted to this pin 9. The connecting rod 10 is pivotably mounted to an arm 11 of the support 1 by means of a bearing pivot 12. The arm 11 is supported on an axis 13 to pivot in the direction of a double arrow 14. The crank 8 rotates in the direction of an arrow 15.

Each beaker 2 is equipped with a dosing hose 16 for a feeding of additives into the inner space of the beaker 2. In the pivoted position 2' of the beakers the dosing hoses have attained the position 16'. Each dosing hose 16 is connected to a lid 3 of a beaker. The heater 5 is designed as planar infrared rays emitter apparatus. Due to the crank drive 7–10 of the embodiment according to FIG. 1 the course of the speed of the movement of the beakers 2 is sinusoidal. If this nonuniform movement is not desired, it is quite obvious that a different drive for the support 1 can be foreseen, such as e.g. illustrated in the embodiment according to FIG. 2. Here the beakers 2 are uniformly moved into the position 2', whereby the support 1 for the beakers 2 is pivoted by means of a piston-cylinder-apparatus 17. This apparatus 17 is operated by means of a flowing medium via the conduit 18 or 19. The piston rod 20 supports a toothed rack 21, which meshes with a pinion 22 which is mounted to the support 1 for rotation therewith.

Figure 2:
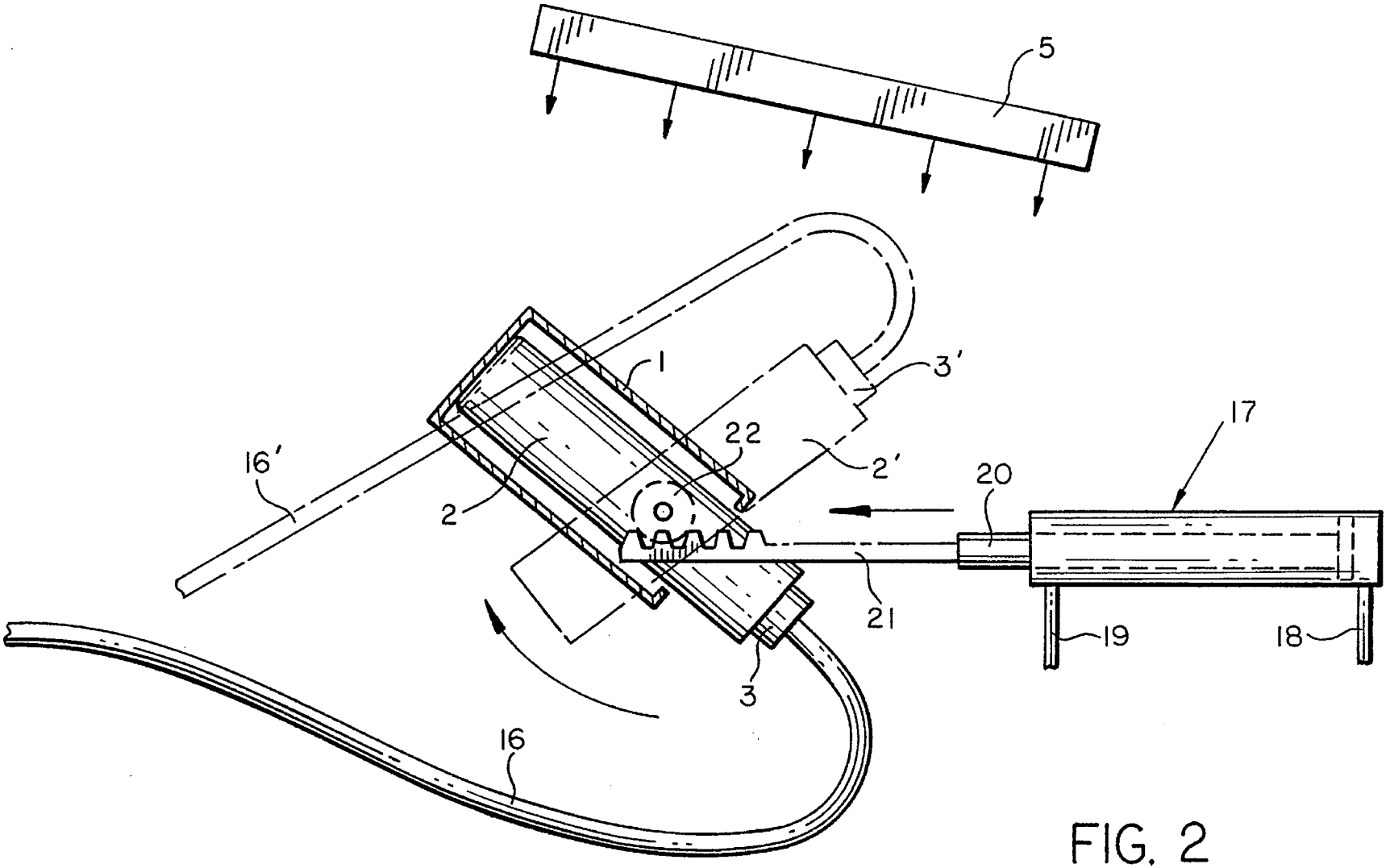
FIG. 2 illustrates a second embodiment, in which the support for the beakers is driven by means of a toothed rack.

By means of the described inventive beaker type dyeing machines in accordance with FIGS. 1 and 2 the demands set forth above can be met. At various groups of dyeing materials, specifically, however, for dyeing operations with reactive dyeing materials a controlled dosing via the dosing hose 16 leads no substantially improved results regarding the transferability, i.e. the extracting and mixing of the dyeing material out of the dyeing liquor onto the material to be dyed occurs only after the adding of the additive. The time of starting and also the characteristics of the dosing must be programmed in accordance with the dyeing process and can accordingly be suited for this process without that the dyeing process must be interrupted. Accordingly, it is possible to proceed with the beaker type dyeing machine structured in accordance with the invention in the same manner as it will be done later during the production proper.

It is also possible to use a combination of crank apparatus and toothed rack for the drive of the support 1.

While there are shown and described present preferred embodiments of the invention, it is to be distinctly understood that same is not limited thereto, but may be otherwise variously embodied and practiced within the scope of the following claims.

I claim:

1. A dyeing apparatus, comprising a plurality of beakers for materials to be dyed, each beaker being provided with a lid and having a longitudinal axis, a support for receiving the beakers, said support containing dyeing liquor, a drive means for reciprocatingly pivoting said beakers relative to said longitudinal axes, and a heater for heating said beakers, wherein each beaker is equipped with a dosing hose for adding additives into the inner space of the beaker and the heater comprises a planar infrared rays emitter apparatus.

2. The apparatus of claim 1, wherein the drive means comprises a crank assembly.

3. The apparatus of claim 1, wherein the drive means comprises a piston-cylinder-apparatus operated by a flow medium and having a toothed rack mounted to its piston rod, whereby a pinion of the support meshes with the toothed rack.

4. The apparatus of claim 1, wherein the dosing hose is connected to the lid of the beaker.

* * * * *